US007958856B2

(12) United States Patent
Meintschel et al.

(10) Patent No.: US 7,958,856 B2
(45) Date of Patent: Jun. 14, 2011

(54) ADJUSTING DEVICE FOR AN INTERNAL COMBUSTION ENGINE, IN PARTICULAR CAMSHAFT ADJUSTING DEVICE

(75) Inventors: Jens Meintschel, Esslingen (DE); Thomas Stolk, Kirchheim (DE); Alexander von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 367 days.

(21) Appl. No.: 12/070,341

(22) Filed: Feb. 15, 2008

(65) Prior Publication Data

US 2008/0210183 A1 Sep. 4, 2008

Related U.S. Application Data

(63) Continuation-in-part of application No. PCT/EP2006/007483, filed on Jul. 28, 2006.

(30) Foreign Application Priority Data

Aug. 20, 2005 (DE) ..... 10 2005 039 460

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31

See application file for complete search history.

(56) References Cited

U.S. PATENT DOCUMENTS

2003/0033999 A1* 2/2003 Gardner et al. ..... 123/90.17

FOREIGN PATENT DOCUMENTS

| | | |
|---|---|---|
| DE | 39 37 644 | 5/1991 |
| DE | 196 11 365 | 9/1997 |
| DE | 198 17 319 | 10/1999 |
| DE | 102 20 687 | 11/2003 |
| DE | 103 30 449 | 2/2005 |
| EP | 0 429 377 | 5/2001 |

* cited by examiner

*Primary Examiner* — Zelalem Eshete
(74) *Attorney, Agent, or Firm* — Klaus J. Bach

(57) ABSTRACT

In an adjusting device for an internal combustion engine, in particular a camshaft adjusting device, an adjusting unit is provided which comprises at least one currentless sensor unit for carrying out in at least one mode an adjustment as a function of a momentary phase angle between cooperating relatively rotatable members.

9 Claims, 6 Drawing Sheets

5 / 6

ADJUSTING DEVICE FOR AN INTERNAL COMBUSTION ENGINE, IN PARTICULAR CAMSHAFT ADJUSTING DEVICE

This is a Continuation-In-Part Application of pending International patent application PCT/EP2006/007483 filed Jul. 28, 2006 and claiming the priority of German patent application 10 2005 039 460.4 filed Aug. 20, 2005.

BACKGROUND OF THE INVENTION

The invention relates to an adjusting device for an internal combustion engine, in particular a camshaft adjusting device, with an adjusting unit including a currentless sensor for setting the phase angle of a shaft, particularly a camshaft relative to a crankshaft.

DE 102 20 687 A1 discloses a camshaft adjusting device with an adjusting unit and a locking unit. The adjusting unit has an adjusting structure with a given transmission ratio designed in such a manner that a locking position is reached by simply setting the position of an adjusting shaft.

It is the object of the present invention to provide a particularly fail-safe adjusting device.

SUMMARY OF THE INVENTION

In an adjusting device for an internal combustion engine, in particular a camshaft adjusting device, an adjusting unit is provided which comprises at least one currentless sensor unit for carrying out in at least one mode an adjustment as a function of a momentary phase angle between cooperating relatively rotatable members.

By means of the currentless sensor unit, i.e. a sensor unit, by means of which sensing is possible without an electric power supply, a particularly fail-safe control arrangement can be obtained. In particular if the adjusting unit is provided for actuating an adjusting means currentlessly, i.e. without electric power, in the at least one mode. In particular, a phase position control can be obtained which is largely independent of an electric current supply. In this case, the sensor unit can be provided exclusively for sensing corresponding characteristic variables so as to be redundant with respect to a further, in particular electronic, sensor unit. In this case, a "shaft phase angle" is to be understood as meaning a phase angle of a first shaft with respect to a second shaft, as exists in particular in the case of a camshaft which is driven by a crankshaft and has a camshaft adjusting device.

In a further refinement of the invention, the sensor unit includes a mechanical scanning device, as a result of which the sensor unit can be structurally simple, in particular also operate independently of a particular oil pressure. However, as an alternative and/or in addition to a mechanical scanning unit, the sensor unit could also have a hydraulic unit for sensing a momentary shaft phase angle.

Furthermore, the scanning unit may be capable of actuating adjusting means, so that additional components, construction space, weight, outlay on installation and costs can be saved. In particular, a scanning means of the scanning unit may be coupled at least to an adjusting means, such as to a brake unit, a valve piston, etc., or it may even be at least partially formed integrally with the same. In the case of electric adjusting devices, mechanical electric contacts can be switched by means of the scanning unit.

In a camshaft adjusting device, a scanning means formed by a scanning contour can be rotationally fixed with a chain wheel or with a camshaft. In camshaft adjusting devices with a summing gear structure, one mechanical scanning means can be connected in a rotationally fixed manner to an adjusting input and one mechanical scanning means can be connected in a rotationally fixed manner to a camshaft, and/or one mechanical scanning means can be connected in a rotationally fixed manner to an adjusting input and one mechanical scanning means can be connected in a rotationally fixed manner to a chain wheel, etc.

During the adjustment of the shaft phase angle, use may be made of torque variations effective on the camshaft, such as variations in the torque needed for driving the shaft, whose phase angle is to be adjusted, during the transmission of a driving torque via the shaft. Advantageously, an adjuster driving torque may be utilized which is primarily provided for obtaining an adjustment of the shaft phase angle so that an adjustment can be obtained independently of a momentary shaft driving torque.

If the adjusting means is coupled in a rotationally fixed manner to the shaft, an advantageous coupling between the adjusting means and a sensor means of the sensor unit, in particular with the mechanical scanning unit, can be obtained in a structurally simple manner with few additional components.

In a further refinement of the invention, the adjusting unit has an adjustable unit for setting a desired position in at least one mode, thus enabling adaptation to different limit conditions during operation and/or, in principle, also before startup.

The solution according to the invention can be used for all internal combustion engine adjusting devices appearing expedient to a person skilled in the art, such as for adjusting devices for adjusting a compression ratio, adjusting devices for adjusting a water pump speed, adjusting devices for adjusting a refrigerant compression device, etc., but particularly advantageously for camshaft adjusting devices, as a result of which a camshaft phase angle can be adjusted over a large range and nevertheless reliable operation of the internal combustion engine is always ensured. Furthermore, it is in principle also conceivable to use a corresponding adjusting device, apart from for internal combustion engines, also for other machines when it appears to be expedient to a person skilled in the art.

The invention and particular advantages thereof will become more readily apparent from the following description on the basis of the accompanying drawings.

DETAILED DESCRIPTION OF PARTICULAR EMBODIMENTS

Figure 1:
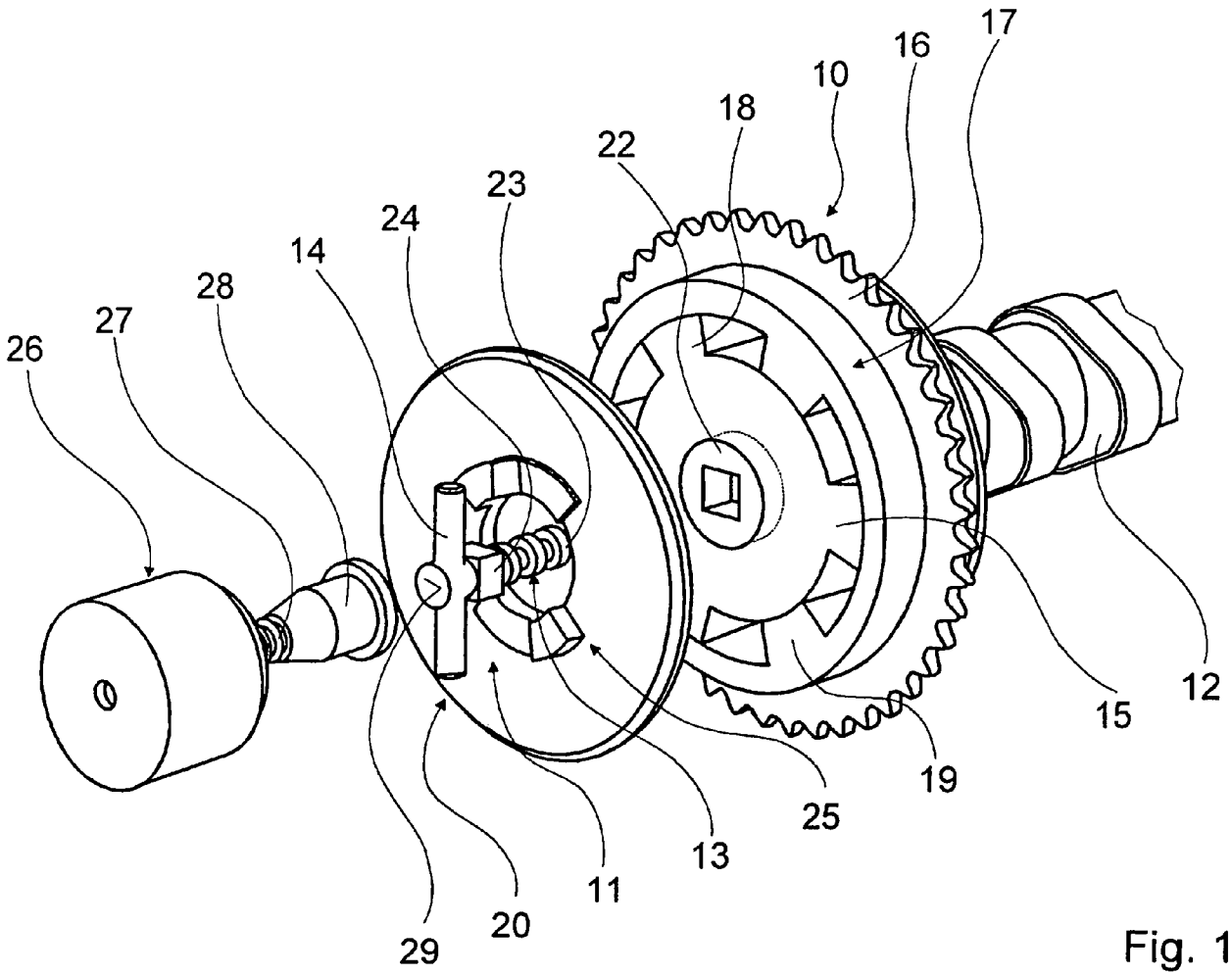
FIG. 1 is an exploded view of a camshaft adjusting device according to the invention shown in connection with a camshaft.
Figure 2:
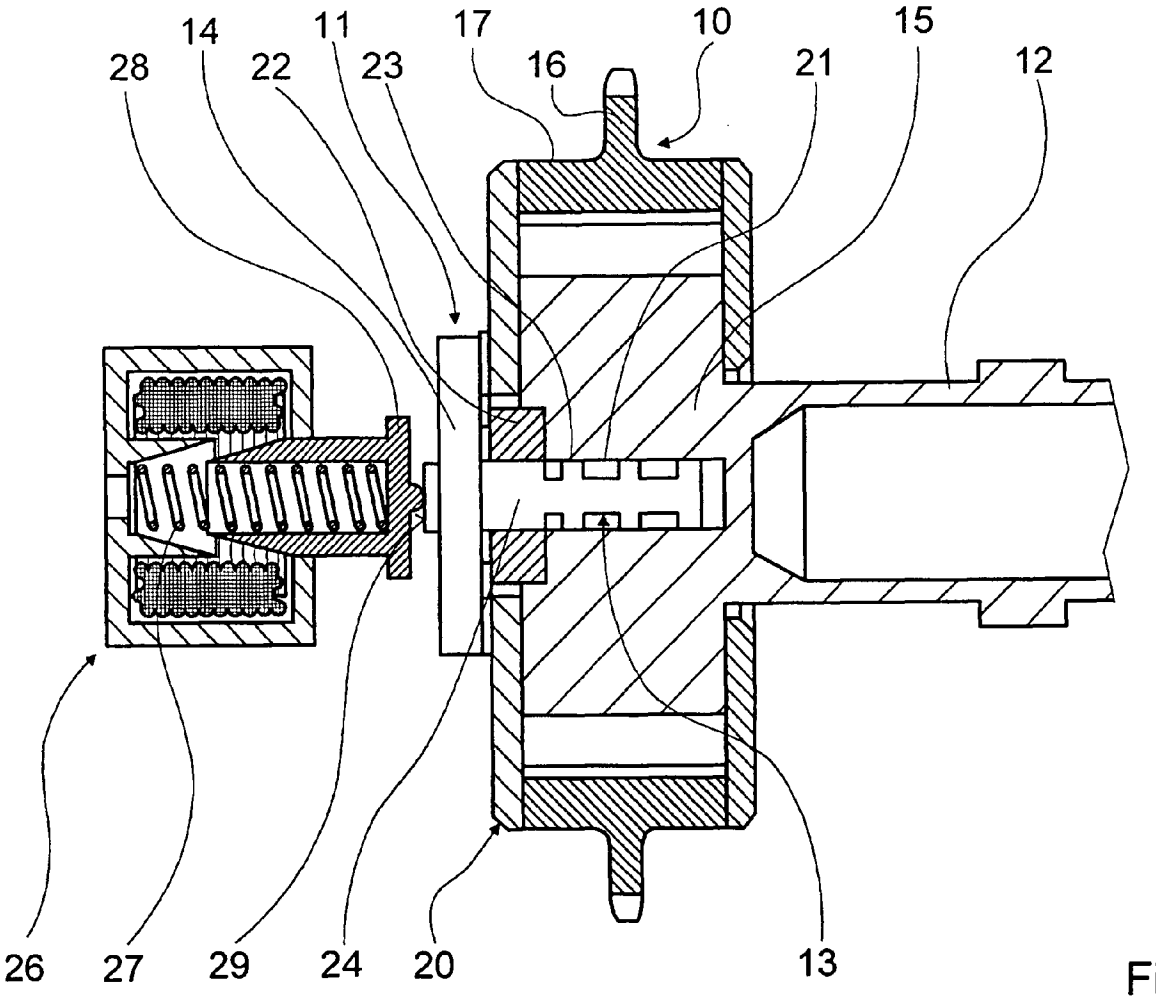
FIG. 2 shows a sectional illustration of the camshaft adjusting device.

FIG. 1 shows a camshaft adjusting device of an internal combustion engine in an exploded illustration with an adjusting unit 10 for adjusting a phase angle of a camshaft 12. The adjusting unit 10 comprises a hydraulic unit which is formed by a vane cell rotary actuator and has a stator 15, which is formed integrally with the camshaft 12, and a rotor 17, which is formed integrally with a chain wheel 16 (FIGS. 1 and 2). The rotor 17 encloses the stator 15 and pressure spaces are formed between radially outwardly projecting vanes 18 of the stator 15 and radially inwardly projecting vanes 19 of the rotor 17, said pressure spaces being closed on a side facing away from the camshaft 12 by a cover 20 of the hydraulic unit. The cover 20 is connected in a rotationally fixed manner to the rotor 17 and therefore in a rotationally fixed manner to the chain wheel 16. Activation of the pressure spaces enables the rotor 17 and therefore the chain wheel 16 to be rotated relative to the stator 15 and therefore to the camshaft 12. As a result, the camshaft, that is, the stator 15 phase angle relative to the rotor 17 and, together therewith, the chain wheel 16, can be adjusted.

An adjusting means or spool 13 formed by a valve piston is arranged in a concentric channel 21 of the stator 15. On a side facing the camshaft 12, the adjusting spool 13 has control edges 23 and, on a side facing away from the camshaft 12, a region 24 with a rectangular cross section is provided via which the adjusting spool 13 is connected to a bush 22 pressed into the camshaft 12 or into the stator 15 in a rotationally fixed manner. Furthermore, a first scanning means 14 of a mechanical scanning unit which forms part of a currentless sensor unit 11 is fastened to the adjusting means 13, the first scanning means being a scanning arm extending perpendicularly to the center axis of the camshaft 12. In addition to the first scanning means 14, the mechanical scanning unit has a second scanning means 25 with a scanning contour which is integrally formed on an end side of the cover 20, which side faces away from the camshaft 12. In order to actuate the adjusting means 13, firstly an electromagnetic adjusting actuator 26 is provided which is actuated by means of its armature 28, which is seated, biased by a helical compression spring 27, on an end surface 29 of the scanning means 14, which surface faces away from the camshaft 12. Furthermore, the scanning unit secondly serves for the currentless actuation of the adjusting spool 13 in an operating mode in which the adjusting actuator 26 is deactivated.

In an electronically controlled operating mode, the electromagnetic control actuator 26 is energized and the armature 28 is moved by electromagnetic forces to its regulating region away from the camshaft 12 against the spring force of the helical compression spring 27. The adjusting spool 13 is acted upon by oil pressure in the direction of the armature 28 and is supported on the armature 28 of the adjusting actuator 26 via the end surface 29. Instead of and/or in addition to being acted upon by oil pressure, the adjusting spool 13 could also be acted upon in the direction of the armature 28 by a spring force of a spring means.

Figure 3:
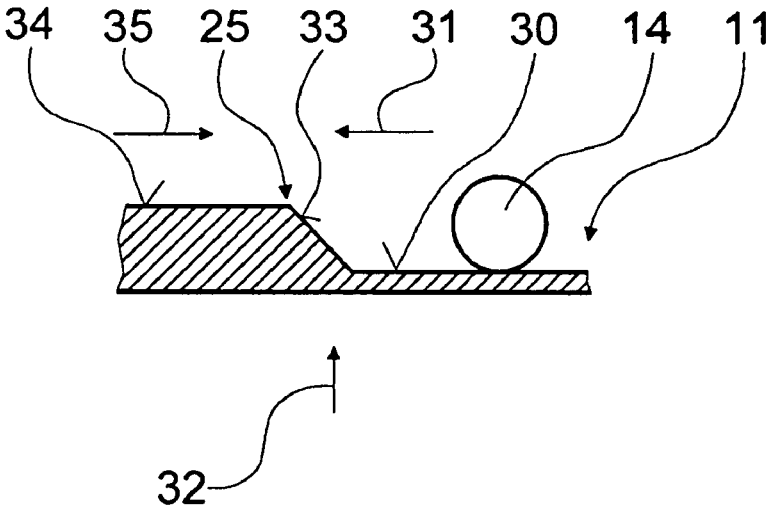
FIG. 3 shows schematically a scanning unit of the camshaft adjusting device with a scanning arm in a first position ahead of a desired position.
Figure 4:
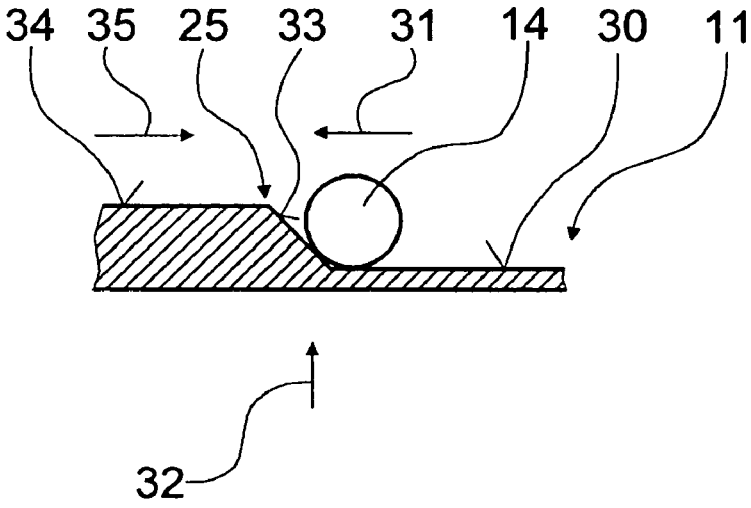
FIG. 4 shows the scanning unit with the scanning arm in the area of the desired position.
Figure 5:
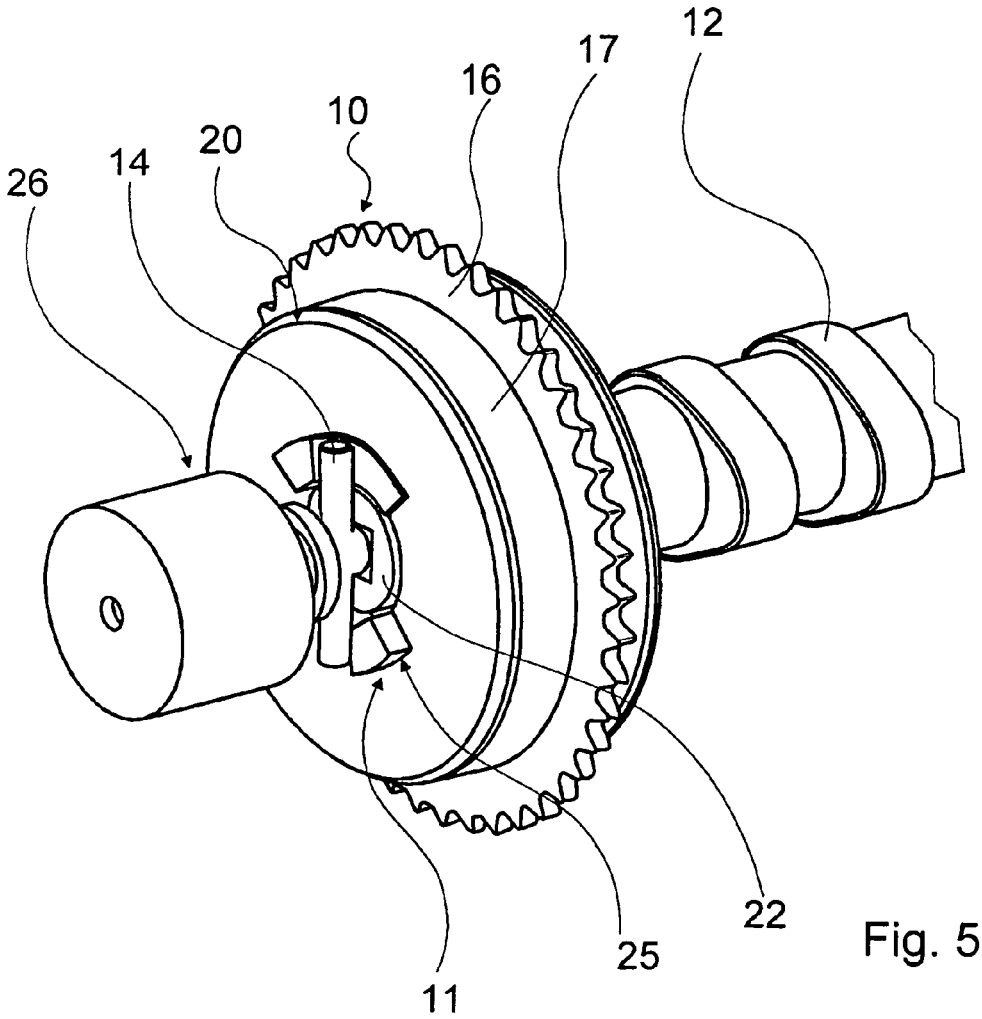
FIG. 5 shows the camshaft adjusting device in a perspective view with the scanning arm in the area of the desired position.

If the adjusting actuator 26 is de-energized in a specific manner or if its supply of current is interrupted in the event of an emergency, for example due to a cable breakage, the scanning means 14, which is formed by the scanning arm, is pressed, driven by the spring force of the helical compression spring 27, which force is greater, than the force generated by the oil pressure acting on the adjusting means 13 against the scanning means 25 formed by the scanning contour. If, upon deactivation of the electromagnetic adjusting actuator 26, the camshaft 12 is adjusted in the advance direction relative to the chain wheel 16 and, therefore, relative to a crankshaft, which is coupled to the chain wheel 16, the scanning means 14 formed by the scanning arm comes into contact with a first bearing surface 30 of the scanning means 25 formed by the scanning contour (FIG. 3). In this case, the adjustment valve spool 13 is positioned in the axial direction in such a manner that the hydraulic unit of the adjusting unit 10 adjusts the camshaft 12 in the adjusting direction 31 or in the retarded direction (FIGS. 4 and 5). An adjuster driving torque of the hydraulic unit is used for the adjustment of the camshaft phase angle. The adjustment movement of the camshaft 12 causes the scanning means 14 formed by the scanning arm to be moved toward a desired position 32.

Figure 6:
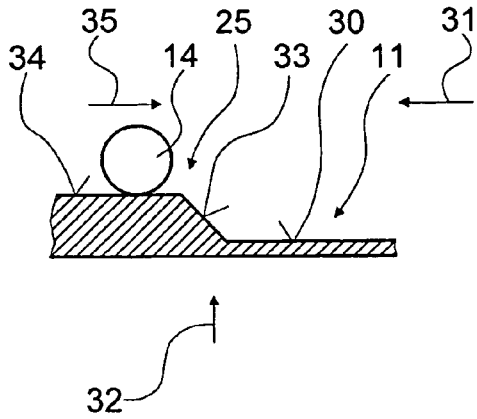
FIG. 6 shows the scanning unit with the scanning arm in a second position ahead of the desired position.
Figure 7:
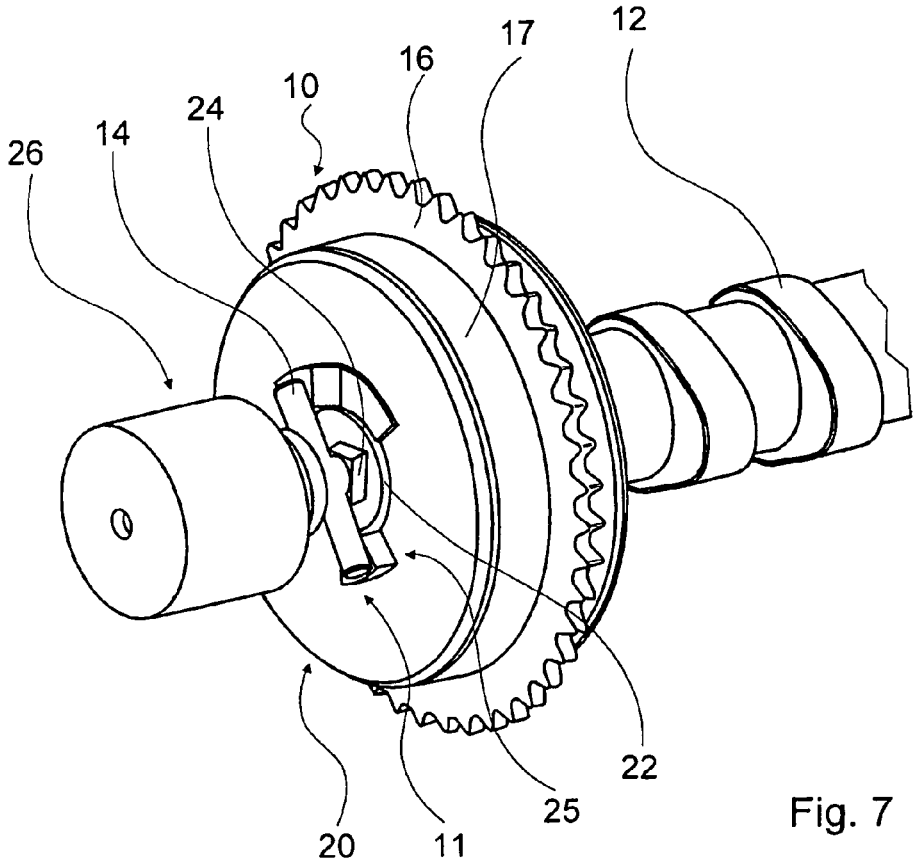
FIG. 7 shows the camshaft adjusting device in a perspective side view with the scanning arm in the second position ahead of the desired position.

In the region of the desired position 32, the scanning means 25 formed by the scanning contour has a control ramp 33 which on extends between the first bearing surface 30 and a second, bearing surface 34. If, upon deactivation of the electromagnetic adjusting actuator 26, the camshaft 12 is adjusted in the retarded direction relative to the chain wheel 16 and therefore to the crankshaft, the scanning means 14 formed by the scanning arm comes into contact with the second bearing surface 34 of the scanning means 25 formed by the scanning contour. The second bearing surface being displaced in relation to the first bearing surface 30 in the axial direction facing away from the camshaft 12 (FIGS. 6 and 7). In this case, the adjusting spool 13 is positioned in the axial direction in such a manner that the hydraulic unit of the adjusting unit 10 adjusts the camshaft 12 in the adjusting direction 35 or in the advanced direction (FIGS. 4 and 6). The scanning means 14 formed by the scanning arm slides from the bearing surface 34 along the control ramp 33 in the direction of the bearing surface 30, that is, in the direction of the desired, position 32 and thereby adjusts the adjusting spool 13 axially such that, when an electromagnetic adjusting actuator 26 is deactivated, a small oscillating movement about the desired position 32 occurs. Since a slight oscillation about the desired position 32 can be permitted, an embodiment without mechanical, locking is to be preferred, in particular since such an embodiment can be designed more cost-effectively in comparison to a camshaft adjusting device with mechanical locking, and noises due to play-afflicted locking means can be avoided in a simple manner.

In order to make a sensor unit 11 adjustable, the second scanning means 25 could be formed, for example, by a component which is separated from the cover 20 and is basically connected in a rotationally fixed manner to the cover 20 and therefore to the chain wheel 16, but, in order to adjust the sensor unit 11 and therefore to adjust the camshaft phase angle in the desired position 32 relative to the cover 20, can be rotated, for example by means of a hydraulic and/or electromagnetic actuator. As an alternative and/or in addition, the scanning means 14 could also be designed to be adjustable in the circumferential direction, for example the bush 22 could be designed to be adjustable in the circumferential direction within the stator 15.

Figure 8:
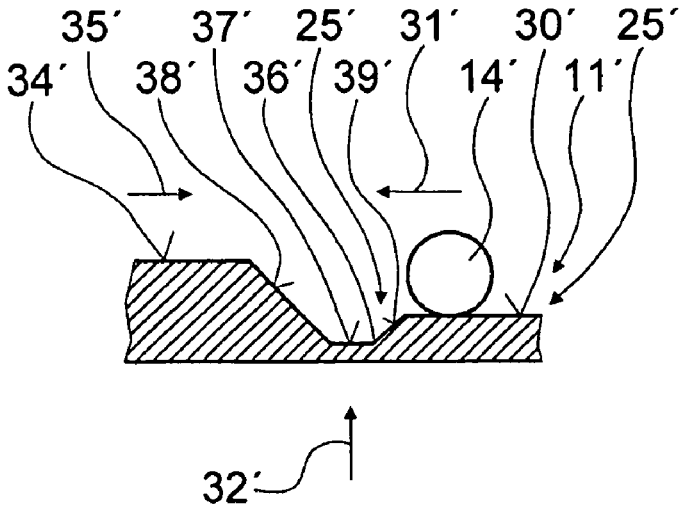
FIG. 8 shows an alternative scanning unit with a scanning arm in a first position ahead of a desired position.
Figure 9:
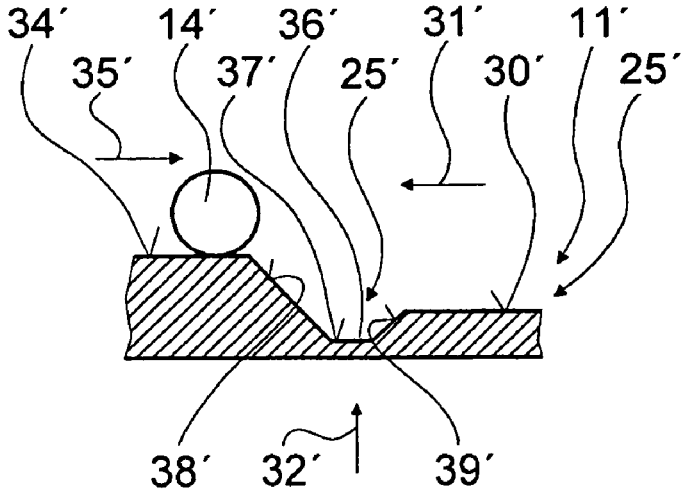
FIG. 9 shows the alternative scanning unit of FIG. 8 with the scanning arm in a second position ahead of the desired position.
Figure 10:
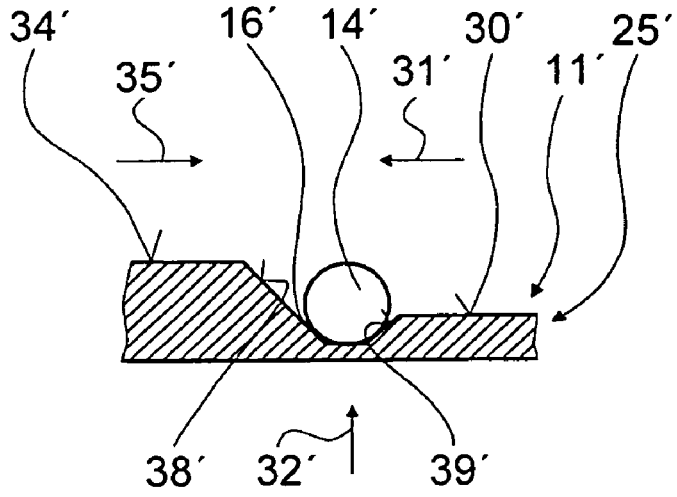
FIG. 10 shows the alternative scanning unit with the scanning arm in the desired position.

FIGS. 8 to 10 illustrate an alternative scanning unit. Components which are essentially the same are basically numbered with the same reference numbers, with an apostrophe being added to the reference numbers in FIGS. 8 to 10 to differentiate between the exemplary embodiments. Furthermore, reference may be made to the description for the exemplary embodiment in FIGS. 1 to 7 in respect of features and functions which remain the same. The description below is restricted essentially to the differences over the exemplary embodiment in FIGS. 1 to 7. The scanning unit illustrated in FIGS. 8 to 10 may be used instead of the scanning unit illustrated in FIGS. 1 to 7, and therefore, with respect of components which are not illustrated to the components in FIGS. 1 to 7, reference is made to the description of FIGS. 8 to 10.

If, in the exemplary embodiment in FIGS. 8 to 10, the adjusting actuator 26 is de-energized or its supply of current is interrupted in the event of an emergency, a scanning means 14' formed by a scanning arm is pressed by the spring force of the helical compression spring 27 of the electro-magnetic adjusting actuator 26, against a scanning means 25' formed by a scanning contour (FIGS. 1 and 8). If, upon deactivation of the electromagnetic adjusting actuator 26, the camshaft 12 is adjusted in the advanced direction relative to the chain wheel 16 and therefore to the crankshaft, the scanning means 14' formed by the scanning arm comes into contact with a first bearing surface 30' of the scanning means 25' formed by the scanning contour (FIG. 8). In this case, the adjusting means 13 is positioned in the axial direction in such a manner that the hydraulic unit of the adjusting unit 10 adjusts the camshaft 12 in the adjusting direction 31' or in the retarded direction (FIGS. 8 and 10). An adjuster driving torque of the hydraulic unit is used to adjust the camshaft phase angle. The adjustment movement of the camshaft 12 causes the scanning means 14' formed by the scanning arm to be moved in the direction of a desired position 32'. In a region assigned to the desired position 32', the scanning means 25' has a retaining recess 36' with inclined side walls or control ramps 38', 39' and with a surface 37' into which the scanning means 14' latches upon reaching the desired position 32'. Here, the scanning means 14' is secured by the spring force of the helical compression spring 27. In this case, the scanning means 14' bears against the inclined side walls, that is, against the control ramps 38', 39' of the locking recess 36', and therefore it is secured in a play-free manner. In the desired position 32', the scanning means 14' and therefore the adjusting spool 13 is arranged further in the direction of the camshaft 12, in comparison to the scanning means 14' bearing against the bearing surface 30', to be precise the adjusting spool 13 is arranged in a neutral position in which neither an adjustment in the advanced direction nor an adjustment in the retarded direction is initiated.

If, upon de-energization of the electromagnetic adjusting actuator 26, the camshaft 12 is adjusted in the retarded direction relative to the chain wheel 16 and therefore to the crankshaft, the scanning means 14' formed by the scanning arm comes to bear against a second bearing surface 34' of the scanning means 25' formed by the scanning contour, which bearing surface is displaced in relation to the first bearing surface 30' further in the axial direction facing away from the camshaft 12 (FIG. 9). In this case, the adjusting spool 13 is positioned in the axial direction in such a manner that the hydraulic unit of the adjusting unit 10 adjusts the camshaft 12 in the adjusting direction 35' or in the advanced direction (FIGS. 9 and 10). The adjustment movement of the camshaft 12 causes the scanning means 14' formed by the scanning arm to be moved in the direction of the desired position 32' and to latch in the locking recess 36'.

What is claimed is:

1. An adjusting device for adjusting a camshaft (12) of an internal combustion engine, including an adjusting unit (10) for adjusting a phase angle of the camshaft (12) relative to a camshaft drive, a control means (13) axially movably disposed in the adjusting unit (10) for controlling the phase angle position of the camshaft relative to the camshaft drive, an actuator (26) for actuating the control means (13) and a sensor unit (11) arranged operatively between the actuator (26) and the control means (13) for operating the control means (13) upon failure of the actuator (26), said sensor unit (11) including a sensor unit (14) disposed adjacent the control means (13) and connected to the camshaft (12) for rotation therewith and a scanning structure (25) arranged adjacent the sensor unit (14) and in engagement with the camshaft drive for rotation therewith so as to actuate, upon failure of the actuator (16), the control means (13) depending on the position of the sensor unit (14) relative to the scanning structure (25).

2. The adjusting device according to claim 1, wherein the adjusting unit (10) includes a housing with a front cover (20) having an opening around which the scanning structure (25) is disposed on the front cover, (20) and the sensor unit (14) is disposed adjacent the scanning structure (25) and in contact with the control means (13) via the opening.

3. The adjusting device according to claim 2, wherein the scanning structure (25) is in the form of a contour member which is disposed on the front cover (20) and which includes a first bearing surface (30) and a second bearing surface (34) with a control ramp (33) extending therebetween.

4. The adjusting device according to claim 3, wherein the scanning structure (25) is adjustably mounted to the front cover (20).

5. The adjusting device according to claim 3, wherein the sensor unit (14) includes arms in contact with the bearing surfaces (30, 34) and the control ramp (33) of the scanning structure (25).

6. The adjusting device according to claim 1, wherein the adjusting means (13) is a control valve with a spool which is coupled in a rotationally fixed manner to the shaft (12), but is axially movable relative thereto.

7. The adjusting device according to claim 1, wherein the adjusting unit (10) includes means for moving the relatively movable drive member (16) and the camshaft (12) to an adjustable desired position upon failure of the actuator (26).

8. The adjusting device according to claim 1, wherein the actuator (26) includes an armature (28) spring-biased into contact with the sensor unit (14) for biasing the sensor unit (14) toward the scanning structure (25).

9. The adjusting device according to claim 1, wherein the adjusting means (13) is provided with means for biasing the adjusting means (13) toward the armature (28).

* * * * *